US008241431B2

(12) United States Patent
Scheringer et al.

(10) Patent No.: US 8,241,431 B2
(45) Date of Patent: Aug. 14, 2012

(54) METHOD FOR DISTRIBUTING A FLUID IN AN AUTOMATIC CLEANING MACHINE

(75) Inventors: Stefan Scheringer, Offenburg (DE); Michael Streb, Iffezheim (DE); Engelbert Ecker, Offenburg (DE); Thomas Peukert, Oberkirch (DE); Bruno Gaus, Offenburg (DE); Joachim Kupetz, Berghaupten (DE); Wendelin Hils, Rheinmuenster (DE); Denis Lehmann, Ortenberg (DE); Thomas Roederer, Hohberg (DE)

(73) Assignee: Meiko Maschinenbau GmbH & Co KG, Offenburg (DE)

( * ) Notice: Subject to any disclaimer, the term of this patent is extended or adjusted under 35 U.S.C. 154(b) by 460 days.

(21) Appl. No.: 12/444,556

(22) PCT Filed: Oct. 5, 2007

(86) PCT No.: PCT/EP2007/008667

§ 371 (c)(1),
(2), (4) Date: Nov. 24, 2009

(87) PCT Pub. No.: WO2008/043488

PCT Pub. Date: Apr. 17, 2008

(65) Prior Publication Data

US 2010/0065088 A1 Mar. 18, 2010

(30) Foreign Application Priority Data

Oct. 6, 2006 (DE) ..... 10 2006 047 344

(51) Int. Cl.

| | |
|---|---|
| ***B08B 9/24*** | (2006.01) |
| ***B08B 9/30*** | (2006.01) |
| ***B08B 9/42*** | (2006.01) |
| ***B08B 3/02*** | (2006.01) |
| ***B08B 3/04*** | (2006.01) |

(52) U.S. Cl. ..... 134/18; 134/25.2; 134/26; 134/29; 134/32; 134/36; 134/56 D; 134/72; 134/131; 134/151

(58) Field of Classification Search ..... 134/18, 134/26, 32, 36, 56 D, 72, 131, 151, 199, 25.2
See application file for complete search history.

(56) References Cited

U.S. PATENT DOCUMENTS

| | | | | |
|---|---|---|---|---|
| 2,388,258 | A | 11/1945 | Federighi | |
| 2,904,256 | A | 9/1959 | Devaney, Jr. | |
| 3,487,468 | A * | 12/1969 | Bahnsen | 8/149.1 |
| 5,135,014 | A * | 8/1992 | Beswick | 134/60 |
| 5,409,545 | A * | 4/1995 | Levey et al. | 134/22.18 |

(Continued)

FOREIGN PATENT DOCUMENTS

| | | |
|---|---|---|
| CH | 437 678 A | 6/1967 |

(Continued)

*Primary Examiner* — Michael Kornakov
*Assistant Examiner* — Natasha Campbell
(74) *Attorney, Agent, or Firm* — Muncy, Geissler, Olds & Lowe, PLLC

(57) ABSTRACT

The invention relates to a method and an apparatus for applying a fluid (32) to items (14) to be cleaned, which items are continuously or intermittently transported in the conveying direction (12) in an automatic cleaning machine, preferably an automatic pass-through dishwasher. At least two, preferably tubular, spray bodies (26.1, 26.2, 26.3, . . . 26.n) which are spaced apart from one another are arranged in at least one spray plane (22, 24) which is oriented parallel to the conveying direction (12) of the items (14) to be cleaned.

19 Claims, 3 Drawing Sheets

U.S. PATENT DOCUMENTS

Figure 2:
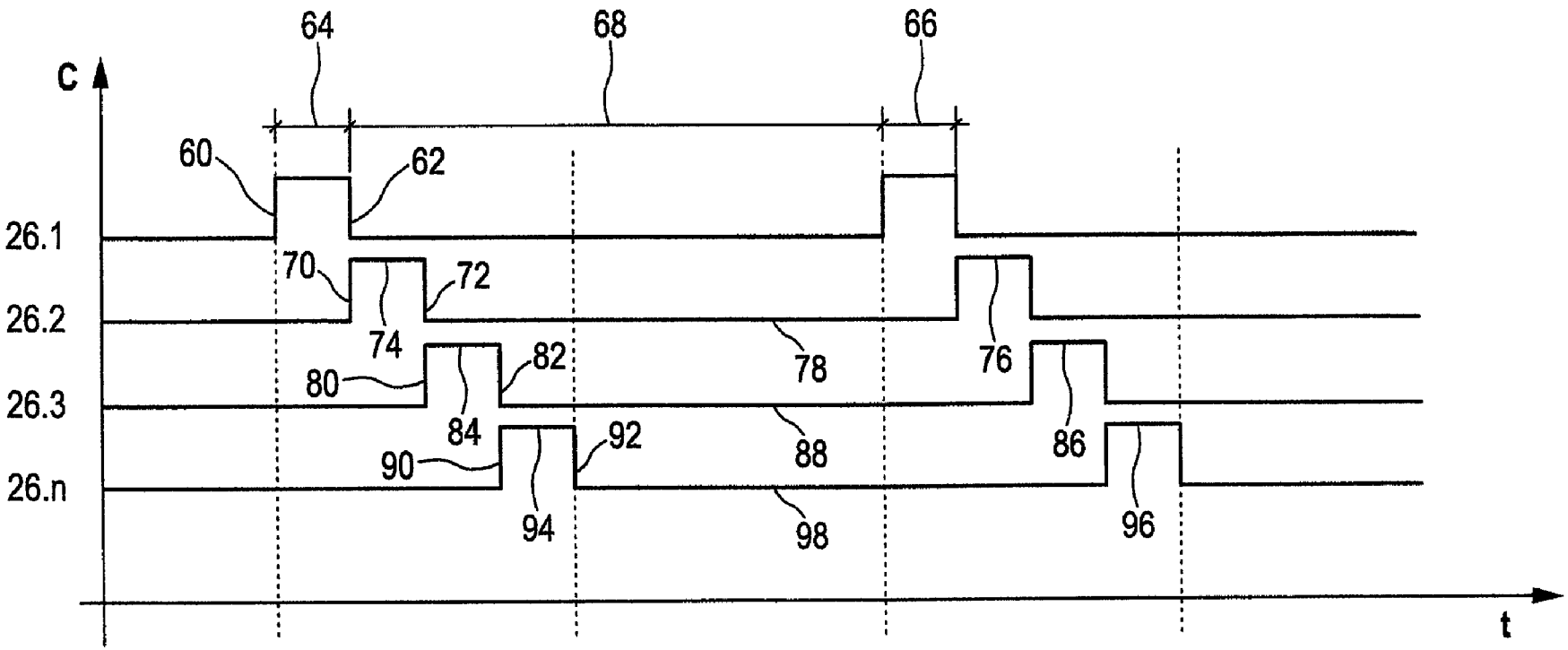

| | | | | |
|---|---|---|---|---|
| 5,497,798 | A | 3/1996 | Fritz et al. | |
| 5,564,448 | A * | 10/1996 | Lincoln | 134/166 R |
| 2007/0079850 | A1 | 4/2007 | Jerg et al. | |

FOREIGN PATENT DOCUMENTS

| | | | |
|---|---|---|---|
| DE | 196 08 030 | C1 | 7/1997 |
| DE | 103 51 785 | A1 | 6/2005 |
| DE | 10 2004 030 001 | A1 | 1/2006 |
| DE | 10 2004 049 392 | A1 | 4/2006 |
| DE | 10 2005 004 300 | A1 | 8/2006 |
| DE | 10 2006 014 464 | B3 | 10/2007 |
| EP | 1 040 785 | A1 | 10/2000 |
| WO | WO 00/53076 | | 9/2000 |

* cited by examiner

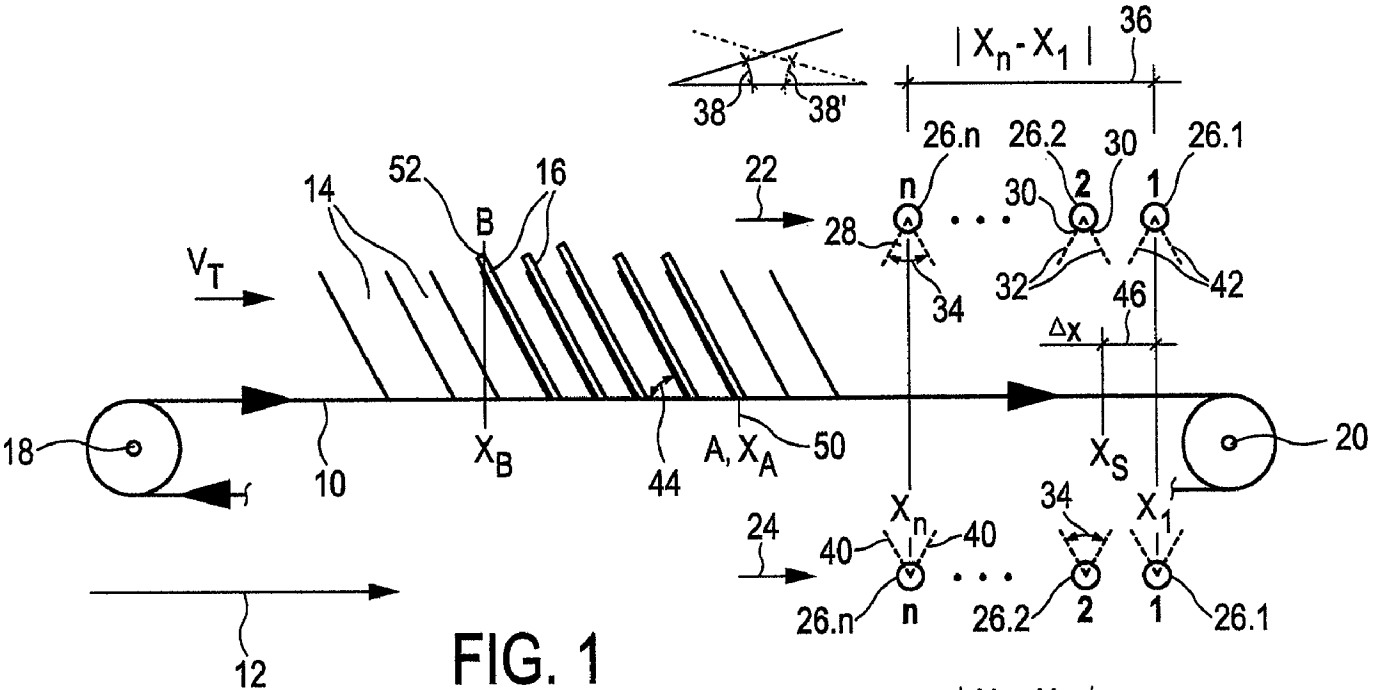
FIG. 1
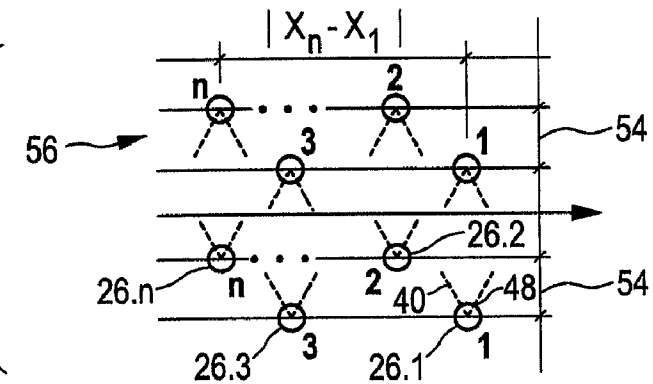
FIG. 1.1

METHOD FOR DISTRIBUTING A FLUID IN AN AUTOMATIC CLEANING MACHINE

This application is a national stage of International Application No.: PCT/EP2007/008667, which was filed on Oct. 5, 2007, and which claims priority to German Patent Application No.: 10 2006 047 344.2, which was filed in Germany on Oct. 6, 2006, and which are both herein incorporated by reference.

TECHNICAL FIELD

The present invention relates to a method and an apparatus for introducing a fluid into an automatic cleaning machine, in particular a pass-through dishwasher for cleaning items, such as dishes, cutlery or the like, to be cleaned.

PRIOR ART

DE 10 2004 049 392 A1 discloses a method for transporting items to be cleaned through a pass-through dishwasher, and a pass-through dishwasher. According to the method disclosed in said document, a pass-through dishwasher comprises at least one wash zone and a final-rinse zone, with the items to be cleaned being cleaned in the wash zone and rinsed in the final-rinse zone. Transportation devices are provided, which are used to transport the items being cleaned in the conveying direction at a transportation speed which is optimum for the process steps being executed in the respective zones. The pass-through dishwasher known from DE 10 2004 049 392 A1 comprises an inlet region, at least one wash zone, at least one final-rinse zone and a drying zone. The pass-through dishwasher also comprises an outlet region, with a plurality of transportation devices being provided as seen in the conveying direction of the items to be cleaned. The transportation devices each have associated individual drives which are operated by means of a controller at transportation speeds which are matched to the processes being executed in the process zones, in order to achieve optimum residence times.

DE 10 2005 004 300 A1 relates to a method and an apparatus for operating a pass-through dishwasher. The pass-through dishwasher disclosed in this document comprises a transportation device for transporting washware through a plurality of treatment zones through which the washware is transported in the transportation direction. In this case, at least one of the spray systems which are provided in the treatment zones can move relative to the transportation direction of the washware. The spray systems are, in particular, final-rinse systems for applying fresh water to the washware to be cleaned.

Whereas the solutions according to DE 10 2004 049 392 A1 and DE 10 2005 004 300 A1 relate to pass-through dishwashers, WO 00/53076 discloses a rack-conveyor dishwasher in which the racks are transported intermittently in an alternating sequence of stationary and translation phases, so that the effective speed is increased during the translation phase given a comparable average transportation speed. In this case, the excessive increase is the necessary result of the ratio of the length of the stationary phase to the translation phase. During the translation phase, a final-rinse volume flow is applied to the items to be cleaned which are stored in the racks.

In the apparatuses known from the prior art, a fluid, in particular a final-rinse liquid, is applied to the washware to be cleaned by means of a spray apparatus. The quantity of final-rinse fresh water required for each item of washware can be reduced, in principle, by the washware being acted on by the final-rinse liquid for a shorter time period than the time period predefined by the speed of the transportation direction, and a final-rinse volume flowing only when there is actually washware in the region in which final-rinse liquid is applied to the washware which has been cleaned.

DESCRIPTION OF THE INVENTION

Taking the above-described prior art as a starting point, the present invention is based on the object of reducing the quantity of final-rinse fluid required and/or improving the effect of a fresh-water final-rinse operation in automatic cleaning machines, in particular dishwashers.

According to the invention, this object is achieved in that the volume flow of final-rinse fluid sprayed over the washware is increased in comparison to conventional final-rinse fluid introduction operations at an unchanged effective transportation speed of the items to be cleaned through the automatic cleaning machine, in particular a pass-through dishwasher, and an apparatus for spraying the final-rinse fluid solution has a plurality of spray bodies. The spray bodies of the apparatus for applying a fluid to the items which have been cleaned preferably comprises tubular spray bodies which are mounted along the transportation direction in a manner arranged at a prespecified distance from one another. The spray bodies can be arranged in a substantially horizontal plane one behind the other. In addition, it is likewise possible to arrange the plane, which is bounded by the two outer, preferably tubular, spray bodies, such that it is inclined or tilted in relation to the transportation direction of the washware through the automatic cleaning machine. In a further design variant of the apparatus proposed according to the invention for spraying a fluid, a plurality of tubular spray bodies can be arranged at a distance and offset from one another in the vertical direction within the apparatus, so that an arrangement of tubular spray bodies, which arrangement takes the form of a zigzag as seen from the side, is essentially produced.

A quantity of final-rinse fluid which is required to rinse a specific quantity of items to be cleaned can, in accordance with the solution proposed according to the invention, be simultaneously introduced via all the individual tubular spray bodies. As an alternative to this, it is possible to apply the final-rinse fluid to the washware which has been cleaned starting at the tubular spray body which is the furthest to the rear as seen in the transportation direction of the items to be cleaned, and final-rinse fluid being applied to the items to be cleaned counter to the transportation direction of the items to be cleaned. This is to be understood such that within the apparatus which is proposed according to the invention and comprises a plurality of tubular spray bodies, final-rinse fluid is introduced counter to the transportation direction of the items to be cleaned through the treatment zones of a pass-through dishwasher, so that the application direction of the fluid from the, preferably tubular, spray bodies of the apparatus which is proposed according to the invention runs in the opposite direction counter to the transportation direction of the cleaned items through the pass-through dishwasher. The tubular spray bodies of the apparatus which is proposed according to the invention for introducing a final-rinse fluid are preferably alternately charged.

The time of a spray cycle is limited and, in addition to other parameters, is controlled as a function of the transportation speed, so that given corresponding charging of the individual, preferably tubular, spray bodies of the apparatus proposed according to the invention, it is possible to apply final-rinse fluid to the items to be cleaned in a clocked manner.

Staggered charging of the spray bodies, which are arranged essentially in one or more planes parallel to the transportation direction of the items to be cleaned, with a fluid, for example final-rinse fluid, creates a "simulated" or "virtual" movement of the, preferably tubular, spray body counter to the transportation direction of the items to be wetted by the fluid. As a result, the same effect is achieved with respect, for example; to final rinsing of items to be cleaned as would be achieved if the items to be wetted were transported more rapidly beneath a stationary spray arm. Charging of a plurality of, preferably tubular, spray bodies in a clocked manner as proposed according to the invention counter to the transportation direction of the washware creates an effect of a spray arm moving counter to the transportation direction of the items to be cleaned relative to the items to be wetted. The quantity of water required for each item of washware is lower since the effectiveness of the washing-off effect is dependent on the volume flow of the fluid running over the washware.

DRAWINGS

Figure 3:
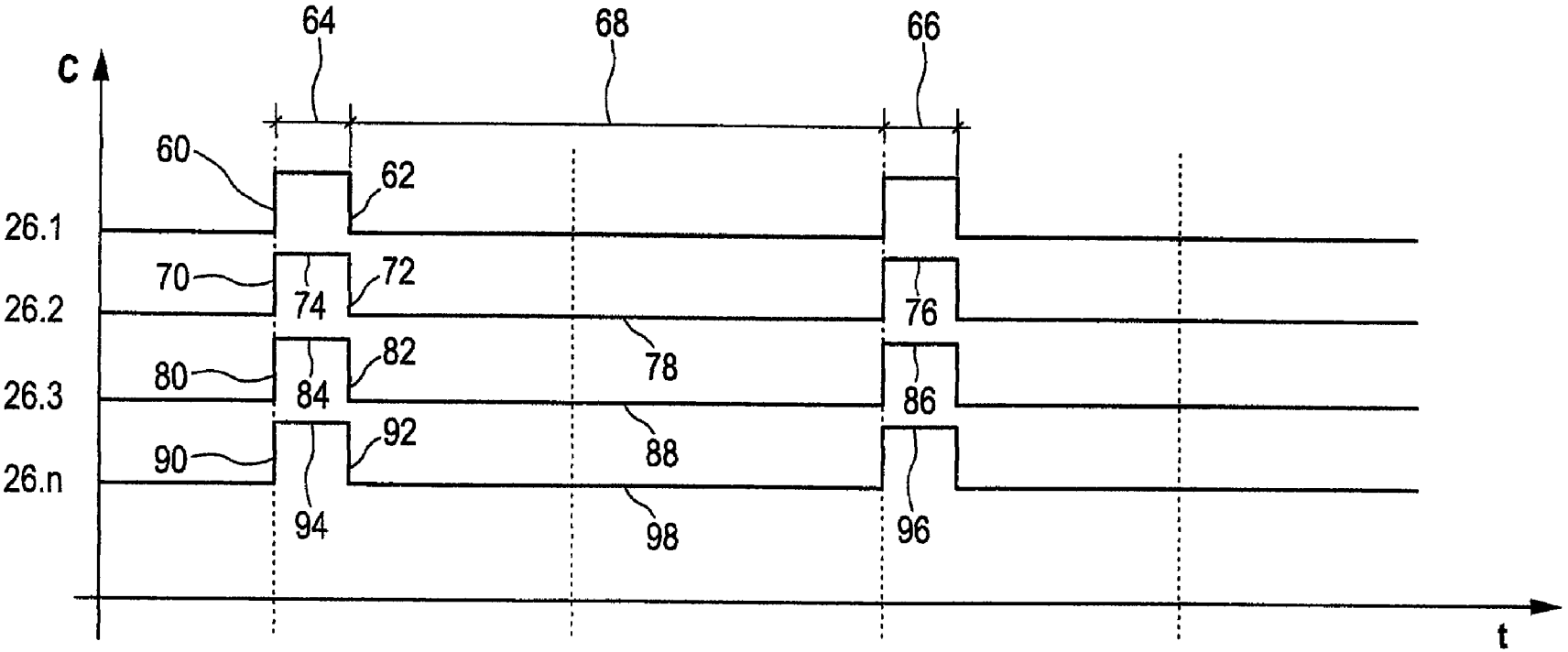

The invention will be described in greater detail below with reference to the drawings, in which:

FIG. 1 shows a schematic reproduction of the spray device which is proposed according to the invention and has a plurality of tubular spray bodies which are arranged in one plane, FIG. 1.1 shows the spray apparatus which is proposed according to the invention and has a zigzag arrangement of tubular spray bodies, FIG. 2 shows an exemplary plan for charging the spray apparatus illustrated in FIGS. 1 and 1.1, and FIG. 3 shows a further plan for charging the spray apparatus illustrated in FIGS. 1 and 1.1.

DESIGN VARIANTS

A final-rinse fluid, for example, is introduced into a final-rinse zone of an automatic cleaning machine via the spray apparatus which is proposed according to the invention and comprises spray bodies which are arranged in a substantially horizontal plane and are spaced apart from one another. Instead of a final-rinse fluid, for example final-rinse liquid, final-rinse fluid can also be applied to the items which are cleaned in the preceding cleaning zones of the automatic pass-through dishwasher within a pump final-rinse zone. Furthermore, the apparatus which is proposed according to the invention for applying a fluid to items to be cleaned, for example washware, can also be used in cleaning zones of an automatic cleaning machine, in particular an automatic pass-through dishwasher.

The apparatus which is proposed according to the invention for applying a fluid, for example a final-rinse liquid, comprises at least two, preferably tubular, spray bodies which are spaced apart from one another. These spray bodies can be arranged both in two substantially horizontal planes and only in one plane, as will be described in greater detail below.

FIG. 1 shows a schematic reproduction of the arrangement of the apparatus which is proposed according to the invention for applying a final-rinse fluid within an automatic cleaning machine, in particular an automatic pass-through dishwasher.

FIG. 1 shows a conveying device 10 (only schematically indicated) which is preferably in the form of a revolving conveyor belt and extends in the conveying direction 12 through an automatic cleaning machine (not illustrated in FIG. 1), in particular a pass-through dishwasher. The conveying device 10 runs around a first deflection means 18 and a second deflection means 20, one of these deflection means being driven. The conveying device 10 is preferably continuous. The conveying device 10, which moves in the conveying direction 12, comprises a number of compartments 14 for accommodating washware 16 which is only schematically indicated in the illustration according to FIG. 1. As an alternative to a continuous conveying device 10 which has compartments 14, it is also possible to place the washware 16 or items to be cleaned in racks which are simply positioned on the upper face of a, preferably continuous, conveying device and are transported through the automatic cleaning machine in this way. Furthermore, the solution which is proposed according to the invention can also be used in automatic cleaning machines, in particular pass-through dishwashers, in which racks accommodating washware 16 or items to be cleaned are continuously or intermittently transported in the conveying direction 12 through the various treatment zones of the automatic cleaning machine by means of a latch-type transporter or the like.

The washware 16 is accommodated in a manner tilted through a tilting angle 44 within the compartments 14. The start of compartments 14 which are loaded with washware 16 and are transported in the conveying direction 12 on the, preferably continuous, conveying device 10 is identified by a start 50 of the batch (cf. A), and the end of the region of compartments 14 which is occupied by washware 16 on the, preferably continuous, conveying device 10 is indicated by reference symbol 52, that is to say an end of the batch B.

The, preferably continuous, conveying device 10 moves in the conveying direction 12 through the automatic cleaning machine in which spray bodies 26.1, 26.2 to . . . **26.*n* are in each case accommodated in a first spray plane 22 and in a second spray plane 24. The spray bodies 26.1, 26.2 . . . 26.*n* which are accommodated in each of the two spray planes 22 or 24** are preferably tubular and extend perpendicular to the plane of the drawing in the automatic cleaning machine which is preferably a pass-through dishwasher.

A fluid, for example final-rinse fluid 32, is discharged, in a manner indicated by a discharge cone 28, from spray openings 30 and 48 from each of the, preferably tubular, spray bodies 26.1, 26.2 . . . **26.*n* arranged in the spray planes 22 and/or 24. The spray openings 30 or 48 are formed over the circumference of the, preferably tubular, spray bodies 26.1, 26.2 . . . 26.*n* as, for example, bores, for example as laser bores. The spray openings 30 and 48 over the circumference of the, preferably tubular, spray bodies 26.1, 26.2, . . . 26.*n* can be used to apply a curtain of final-rinse fluid 32 to the washware 16 which is to be rinsed, for example, and is transported in the conveying direction 12 through the automatic cleaning machine. The discharge cone 28 within which, for example, the final-rinse fluid 32 is discharged from the spray openings 30 and 48 of the, preferably tubular, spray bodies 26.1, 26.2 . . . 26.4 is limited by spray jets of final-rinse fluid 32 which run at a discharge angle 34. Reference symbol 36 indicates the extent of the respective spray planes 22 and 24 in the horizontal direction parallel to the conveying direction 12 of the conveying device 10**.

The illustration according to FIG. 1 further shows that final-rinse fluid 32 in the form of downwardly directed spray jets 42 is applied to the washware 16 to be rinsed via the spray bodies 26.1, 26.2 . . . **26.*n* arranged in the first spray plane 22, and upwardly directed spray jets 40 are applied into a final-rinse zone or to the washware 16 which is to be rinsed and transported through said final-rinse zone in the conveying direction 12 via the, preferably tubular, spray bodies 26.1, 26.2 . . . 26.*n* which are arranged in the second spray plane 24**.

The schematic illustration reproduced in FIG. 1 of the spray apparatus which-is proposed according to the invention shows that the individual, preferably tubular, spray bodies 26.1, 26.2, . . . 26.*n* are arranged with a partition 46, that is to say are at a distance from one another. The first and the second spray planes 22 and 24 according to the schematic illustration in FIG. 1 run parallel to the conveying direction 12 of the, preferably continuous, conveying device 10. In addition, it is also feasible, as indicated in FIG. 1, to arrange the spray bodies 26.1, 26.2, . . . 26.*n* in the spray planes 22 and 24 at an inclination/tilting angle 38, in order to be able to take into account, for example, special installation space conditions within an automatic cleaning machine.

The illustration according to FIG. 1.1 shows an alternative design variant of the apparatus which is proposed according to the invention for applying a fluid to items to be cleaned or washed.

The illustration according to FIG. 1.1 shows that the individual, preferably tubular, spray bodies 26.1, 26.2 . . . 26.*n* are arranged in an alternating manner such that they are offset in relation to one another. To this end, preferably tubular spray bodies 26.1, 26.2 . . . 26.*n* are accommodated in the first spray plane 22, which is situated above the conveying device 10, and in a second spray plane 24, which is arranged below the conveying device 10 which is preferably in the form of a continuous conveyor belt, in the illustration according to FIG. 1. Reference symbol 54 indicates a vertical distance at which the first spray body 26.1 is arranged relative to the second spray body 26.2.

The vertical distance 54 between the individual, preferably tubular, spray bodies 26.1, 26.2 . . . and 26.*n* in the two spray planes 22 and 24 produces different spray or drop heights for, for example, a final-rinse fluid 32 which wets the surface of washware 16 which is to be rinsed, for example, and which runs through a final-rinse zone of an automatic cleaning machine, for example a pass-through dishwasher.

As can be seen in FIGS. 1 and 1.1, it is also possible to design the spray apparatus which is proposed according to the invention to apply a fluid, for example a final-rinse fluid, in substantially horizontal spray planes 22, 24, to arrange the spray planes 22, 24 at an inclination or tilting angle 38 within an automatic cleaning machine, for example a dishwasher, or to design the spray planes 22, 24 such that individual, preferably tubular, spray bodies 26.1, 26.2, 26.3, . . . 26.*n* are arranged in an alternating manner, that is to say said spray bodies are arranged at a vertical distance 54 from one another. The three design variants described are possible with respect to the development of the spray apparatus which is proposed according to the invention.

FIG. 2 shows an example of a charging plan with which the individual, preferably tubular, spray bodies are charged with a final-rinse fluid—to mention one example—which serves, for example, to rinse the washware 16.

The illustration according to FIG. 2 shows that, for, preferably tubular, spray bodies 26.1, 26.2, 26.3, . . . 26.*n* which are arranged in a first spray plane 22 and/or a second spray plane 24, according to the illustrations in FIGS. 1 and 1.1, wetting phases and wetting breaks are plotted relative to one another over the time axis.

The illustration according to FIG. 2 shows, in particular, that spraying is started 60 for the first, preferably tubular, spray body 26.1 when the start 50 of the batch, cf. A in FIG. 1, is in position $X_A$, cf. illustration according to FIG. 1. This means that application of the fluid from the first, preferably tubular, spray body 26.1 which is arranged in the first spray plane 22 and/or in the second spray plane 24 starts exactly when the batch which is illustrated in FIG. 1, from the start 50 of the batch to end 52 of the batch, is moved into the arrangement of spray bodies 26.1, 26.2, . . . 26.*n* which extends horizontally over the extent 36. According to the charging plan for the individual, preferably tubular, spray bodies 26.1, 26.2, 26.3, . . . 26.*n* illustrated in FIG. 2, the final-rinse fluid 32 which is required, for example, to rinse a specific quantity of washware 16 is applied starting from the spray body which is furthest to the rear in the transportation direction 12, that is to say the first spray body 26.1 counter to the conveying direction 12. After the end of a first wetting phase 64, a spraying break 68 at the first, preferably tubular, spray body 26.1 is established when spraying is ended 62, said spraying break being identified by reference symbol 68 in FIG. 2. The spraying break 68 of the first, preferably tubular, spray body 26.1 is followed by a second wetting phase 66, this is also the case at the second spray body 26.2, and so on.

Spraying is started 70 at the second, preferably tubular, spray body 26.2 with a time delay which corresponds, for example, to the duration of a first wetting phase 64. The start 70 of spraying at the second, preferably tubular, spray body 26.2 coincides with the end 62 of spraying of the first, likewise preferably tubular, spray body 26.1. The duration of the first wetting phase 74 at the second, preferably tubular, spray body 26.2 corresponds to the duration of the first wetting phase 64. After the duration of the first wetting phase 74 at the second, preferably tubular, spray body 74 elapses, spraying is ended 72 and this is followed by a spraying break 78 before a second wetting phase 76 of the second, preferably tubular, spray body 26.2 starts. Analogously to clocking of the start of spraying and the end of spraying with respect to the first and the second, preferably tubular, spray bodies 26.1, 26.2, clocking is performed with respect to the first wetting phase 84, the second wetting phase 86 and the spraying break 88 for the third, likewise preferably tubular, spray body 26.3 and for the n-th, likewise tubular, spray body 26.*n*.

The clocking plan according to the illustration in FIG. 2 shows that the, preferably tubular, spray bodies 26.1, 26.2 . . . 26.*n* which are respectively arranged in the first and/or the second spray plane 22, 24 are charged counter to the conveying direction 12 of the washware 16, which is to be rinsed for example, in the automatic cleaning machine which is preferably a pass-through dishwasher. The duration of the respective spraying or wetting phases 64, 74, 84, 94; 66, 76, 86, 96, or the spraying breaks 68, 78, 88 and 98 which occur between said spraying or wetting phases, can be limited and, in addition to other parameters, be controlled, inter alia, as a function of the transportation speed of the washware 16 in the conveying direction 12 through the automatic cleaning machine. In this way, applying fluid 32, for example final-rinse fluid to mention one example, to the washware 16, which is to be rinsed in this case, in a clocked manner can lead to a minimum amount of this fluid 32 being introduced.

In the case of the manner of clocked charging, which is illustrated in FIG. 2, of individual spray bodies 26.1, 26.2, . . . 26.*n* which are preferably tubular, a minimum amount of fluid 32, for example final-rinse fluid, can be introduced into the cleaning machine which is preferably a pass-through dishwasher. On account of the clocked charging of individual spray bodies 26.1, 26.2, . . . 26.*n*—as illustrated in FIG. 2—counter to the conveying direction 12 of the washware 16 to be cleaned, the same effect is achieved with respect to the washing-away effect which is established as would be achieved in the case of more rapid transportation beneath a stationary spray body. The clocked charging of individual spray bodies 26.1, 26.2, 26.3, . . . 26.*n* which are arranged in at least one spray plane 22, 24 simulates a movement of at least one spray body counter to a conveying movement of the washware 16. The quantity of water required for each item of washware 16 is lower when the effectiveness of the washing-away effect is, at least in regions, proportional to the volume flow of the fluid running over the washware 16.

In addition to the clocking plan illustrated in figure for charging the individual, preferably tubular, spray bodies 26.1, 26.2, 26.3, . . . **26.*n*, it is also possible to charge all the, preferably tubular, spray bodies 26.1, 26.2, 26.3, . . . 26.*n* accommodated in the respective spray planes 22, 24 with fluid 32, for example final-rinse fluid or another liquid which is to be applied to the washware 16, at the same time. By means of this manner of operation, as illustrated in FIG. 3 of the apparatus which is proposed according to the invention in the cleaning machine, in particular the automatic pass-through dishwasher, the volume flow is increased and therefore washing away of particles from the washware 16** is improved while the consumption of water and fluid is lower overall.

As already mentioned above, the apparatus which is proposed according to the invention for applying a fluid 32 to washware or other items 16 to be cleaned, which are continuously or intermittently conveyed through an automatic cleaning machine, can also be formed with the zigzag arrangement 56 illustrated in FIG. 1.1. If the individual, preferably tubular, spray bodies 26.1, 26.2, 26.3, . . . **26.*n* are arranged in at least one spray plane 22, 24 to be offset in relation to one another in the Y-direction by a vertical distance 54, different spray heights or drop heights for the final-rinse fluid 32 or another fluid which is to be applied to washware 16 which is to be cleaned or rinsed are produced. The individual spray bodies 26.1, 26.2, 26.3, . . . 26.*n* which are arranged next to one another in at least one spray plane 22, 24 can be charged in accordance with a fixed clocked charging plan, both by continuous charging of the individual, preferably tubular, spray bodies 26.1, 26.2, 26.3, . . . 26.*n* and by clocked opening of the outlet openings 30, 48. In addition, it is also possible to charge the individual, preferably tubular, spray bodies 26.1, 26.2, 26.3, . . . 26.*n* with the fluid 32 in bursts. Furthermore, a clocked charging plan could have the appearance that fluid 32 is charged to the individual, preferably tubular, spray bodies 26.1, 26.2, 26.3, . . . 26.*n* initially counter to the conveying direction 12 of the items 16 to be cleaned and then in the conveying direction 12 of the items 16 to be cleaned, or else in an alternating sequence by back and forth, alternating charging of the individual spray bodies 26.1, 26.2, 26.3, . . . 26.*n* in the conveying direction 12 and counter to the conveying direction 12 of the items 16** to be cleaned.

List of Reference Symbols

10 Conveying device
12 Conveying direction
14 Compartments
16 Washware
18 1st deflection means
20 2nd deflection means
22 1st spray plane
24 2nd spray plane
26.1 1st spray body
26.2 2nd spray body
26.3 3rd spray body
**26.*n*** n-th spray body
28 Discharge cone
30 Spray opening
32 Final-rinse fluid
34 Discharge cone
36 Extent of the spray plane
38 Inclination/tilting angle
40 Upwardly directed spray jets
42 Downwardly directed spray jets
44 Washware tilting angle
46 Spray apparatus partition
48 Spray opening
50 Start of the batch (A)
52 End of the batch (B)
54 Vertical distance
56 Zigzag arrangement
60 Start of spraying for the 1st spray body
62 End of spraying for the 1st spray body
64 1st wetting phase
66 2nd wetting phase
68 Spraying break
70 Start of spraying for the 2nd spray body
72 End of spraying for the 2nd spray body
74 1st wetting phase of the 2nd spray body
76 2nd wetting phase of the 2nd spray body
78 Spraying break
80 Start of spraying for the 3rd spray body
82 End of spraying for the 3rd spray body
84 1st wetting phase of the 3rd spray body
86 2nd wetting phase-of the 3rd spray body
88 Spraying break
90 Start of spraying for the 4th spray body
92 End of spraying for the 4th spray body
94 1st wetting phase of the 4th spray body
96 2nd wetting phase of the 4th spray body
98 Spraying break

The invention claimed is:

1. A method for applying a fluid to items to be cleaned in an automatic cleaning machine having at least one wash zone and a final-rinse zone, with the items to be cleaned being cleaned in the at least one wash zone and rinsed in the final-rinse zone, with the fluid to be applied being applied to the items to be cleaned by a spray device comprising spray bodies, the spray device being charged in a clocked manner and whose spray bodies are individually charged selectively in accordance with at least one defined plan, wherein the fluid to be applied is applied to the items to be cleaned in an alternating sequence by clocked charging of the spray bodies counter to a conveying direction of the items to be cleaned, and wherein the items to be cleaned are transported continuously or intermittently in the conveying direction and are initially wetted by the spray body which is arranged furthest away from the items to be cleaned in at least one spray plane during a first wetting phase as they are transported in the conveying direction.

2. The method as claimed in claim 1, wherein the fluid to be applied to the items to be cleaned is applied to the items to be cleaned as a function of a program implemented in a machine controller alternately by, in each case, individual spray bodies.

3. The method as claimed in claim 1, wherein individual spray bodies are selected and actuated counter to or in the conveying direction of the items to be cleaned, with a downwardly directed or upwardly directed curtain being produced by fluid to be applied to the items to be cleaned in or counter to the conveying direction in at least one spray plane.

4. The method as claimed in claim 1, wherein the spray bodies are actuated in an alternating and clocked manner counter to the conveying direction of the items to be cleaned.

5. The method as claimed in claim 3, wherein the curtain of fluid which wets the items to be cleaned is produced in at least one spray plane.

6. The method as claimed in claim 3, wherein the upwardly directed and/or downwardly directed curtain of fluid to be applied to the items to be cleaned is generated simultaneously in a first spray plane which extends in the horizontal direction and/or in a second spray plane.

7. The method as claimed in claim 1, wherein, during at least one wetting phase and starting from the spray body which is furthest away from the items to be cleaned, the items to be cleaned are progressively wetted counter to or in the transportation direction of the items to be cleaned.

8. The method as claimed in claim 1, wherein the spray bodies which are arranged in at least one spray plane are charged with a fluid successively counter to the conveying direction or successively in the conveying direction of the items to be cleaned.

9. An apparatus for applying a fluid to items to be cleaned in an automatic cleaning machine, by means of which the items to be cleaned are continuously or intermittently conveyed in a conveying direction on at least one conveying device, with at least two spray bodies which are spaced apart from one another and arranged in at least one spray plane with the apparatus being configured to carry out a method as claimed in claim 1.

10. The apparatus as claimed in claim 9, wherein the at least one spray plane extends substantially parallel to the conveying plane of conveying device.

11. The apparatus as claimed in claim 10, wherein the at least one spray plane runs in a horizontal direction.

12. The apparatus as claimed in claim 9, wherein the at least one spray plane is arranged such that it is tilted at an inclination angle in relation to the conveying plane of the conveying device.

13. The apparatus as claimed in claim 9, wherein a first spray plane is arranged above the conveying plane and a second spray plane is arranged below the conveying plane, in which conveying plane the items to be cleaned are transported in the conveying direction.

14. The apparatus as claimed in claim 9, wherein the spray bodies are accommodated in the at least one spray plane with a zigzag arrangement.

15. The apparatus as claimed in claim 14, wherein the spray bodies are arranged at a vertical distance in relation to one another, such that they alternate in relation to one another, in the at least one spray plane.

16. The apparatus as claimed in claim 9, wherein the spray bodies, which are arranged in at least one spray plane, have over their circumference at least one row of openings via which the fluid to be applied to the items to be cleaned is discharged in the form of a curtain.

17. The method according to claim 1, wherein the spray bodies are tubular.

18. The apparatus according to claim 9, wherein the conveying device is a conveyor belt.

19. A method for applying a fluid to items to be cleaned in an automatic cleaning machine having at least one wash zone and a final-rinse zone, with the items to be cleaned being cleaned in the at least one wash zone and rinsed in the final-rinse zone, the method comprising:

applying the fluid to be applied to the items to be cleaned by a spray device comprising spray bodies, the spray device being charged in a clocked manner and whose spray bodies are individually charged selectively in accordance with at least one defined plan;

applying the fluid to be applied to the items to be cleaned in an alternating sequence by clocked charging of the spray bodies counter to a conveying direction of the items to be cleaned;

transporting the items to be cleaned continuously or intermittently in the conveying direction; and initially wetting the items to be cleaned by the spray body that is arranged furthest away from the items to be cleaned in at least one spray plane during a first wetting phase as the items to be cleaned are transported in the conveying direction.

* * * * *